US005265442A

United States Patent [19]

Lamie

[11] Patent Number: 5,265,442

[45] Date of Patent: Nov. 30, 1993

[54] NON-COMPRESSIVE AUXILIARY AIR CONDITIONING SYSTEM

[76] Inventor: Thomas T. Lamie, 8330 NW. 21st St., Sunrise, Fla. 33322

[21] Appl. No.: 881,773

[22] Filed: May 12, 1992

[51] Int. Cl.[5] ..... F25D 17/00; F25B 7/00

[52] U.S. Cl. ..... 62/404; 62/79; 62/96; 62/99; 62/118; 62/259.1; 62/333; 62/407; 62/238.1

[58] Field of Search ..... 62/79, 89, 96, 98, 99, 62/118, 238.1, 259.1, 304, 309, 310, 314, 331-335, 406-408, 404

[56] References Cited

U.S. PATENT DOCUMENTS

| | | | |
|---|---|---|---|
| 2,153,696 | 4/1939 | Philipp | 62/96 X |
| 2,764,876 | 10/1956 | Pavcaro | 62/434 X |
| 3,156,101 | 11/1964 | McGuffey | 62/430 X |
| 3,822,561 | 7/1974 | Miller | 62/332 X |
| 3,869,870 | 3/1975 | Kuehner | 62/333 X |
| 3,906,742 | 9/1975 | Newton | 62/332 |
| 4,283,925 | 8/1981 | Wildfeuer | 62/332 X |
| 4,815,527 | 3/1989 | Meckler | 62/99 X |
| 4,821,530 | 4/1989 | Ledbetter | 62/332 |
| 5,139,549 | 8/1992 | Knodel et al. | 62/434 X |
| 5,140,829 | 8/1992 | Barwacz | 62/79 X |

OTHER PUBLICATIONS

Harnish, J. R. and Niess, R. C., Power Engineering, "Air Source Heat Pumps", pp. 72-74, Jun. 1958.

*Primary Examiner*—Henry A. Bennet
*Assistant Examiner*—Christopher B. Kilner
*Attorney, Agent, or Firm*—Melvin K. Silverman

[57] ABSTRACT

A system for cooling employee and customer-occupied area of a commercial establishment of a type having an internal refrigerated inventory storage compartment includes a water reservoir located within the refrigerated compartment. Included is an assembly for continually supplying a portion of water from the reservoir to an input of a heat exchanger external of the refrigerated compartment. Further included is an assembly for, after circulation of water through the heat exchanger, return of the water to the water reservoir within the refrigerated compartment. The system also includes an assembly for inputting air external of the refrigerated compartment through the heat exchanger to transfer the air's thermal values to the circulated water. Further provided are a fan and ductwork sub-system for distributing resulting cooled air outputted from the heat exchanger to the employee and customer-occupied areas of the establishment. Otherwise unused refrigeration capacity of the refrigerated inventory storage compartment is thereby utilized to reduce the load upon the normal air conditioning of the establishment outside of the refrigerated inventory storage compartment.

4 Claims, 4 Drawing Sheets

NON-COMPRESSIVE AUXILIARY AIR CONDITIONING SYSTEM

BACKGROUND OF THE INVENTION

The present invention relates to a supplemental air conditioning system for use with a commercial structure of a type typically equipped with an internal refrigerated storage compartment. For example, restaurants, convenient stores, wholesale meat and vegetable establishments, medical supply companies and various other types of business require the usage of an internal refrigerated storage compartment for the storage of perishable inventory which, typically, will comprise food but, however, may, in certain industrial application, include medicals and chemicals that must be stored below room temperature to maintain their stability.

Where an establishment of the above type is located in a region of the country which makes use of air conditioning, outside of the above internal refrigerated storage compartment, energy and cost is expended in the reduction of the ambient temperature of employee and customer-occupied areas of the establishment. The cost of such cooling of the employee and customer-occupied areas in areas of the country such as Florida and Arizona, where air conditioning is used on a virtually year-round basis, can amount to thousands of dollars per month additional to the cost of refrigeration of the above referred to internal refrigeration storage compartment of the commercial structure.

The instant invention relates to a system by which otherwise wasted or unused refrigeration capability of the internal refrigeration storage compartment of such commercial structures may be employed to reduce the cooling load upon the outside, that is, employee and customer-occupied, areas of the commercial establishment.

To the knowledge of the inventor, there is no prior art which teaches or suggests my non-compressive supplemental air conditioning system relevant to than disclosed herein.

SUMMARY OF THE INVENTION

The invention non-compressive supplemental air conditioning system relates to a system for cooling of a commercial structure having an internal refrigerated storage compartment within which otherwise perishable inventory is stored. The inventive system more particularly includes a water reservoir located within said internal refrigerated storage compartment. Further provided are means for continually supplying a portion of water from said reservoir to an input of a heat exchanger external of said refrigerated compartment. The inventive system further includes means for returning to said reservoir water output from said heat exchanger. The system also includes means for inputting air external of said refrigerated compartment through said heat exchanger to thereby transfer its thermal values to said water. Finally, the system includes fan and duct means for distributing cooled air outputted from said heat exchanger to employee and customer-occupied areas of the commercial establishment.

It is accordingly an object of the present invention to provide a supplemental air conditioning system which utilizes unused or underutilized refrigeration capability of an internal refrigerated storage compartment within a commercial establishment.

It is another object of the present invention to reduce refrigeration costs in a commercial establishment having an internal refrigerated inventory storage compartment.

It is a further object of the present invention to provide an alternative air conditioning system for employee and customer-occupied areas when the external atmospheric temperature is within about ten degrees of the desired internal temperature of the employee and customer-occupied areas of the establishment.

The above and yet other objects and advantages of the present invention will become apparent from the hereinafter set forth Brief Description of the Drawings, Detailed Description of the Invention, and Claims appended herewith.

DETAILED DESCRIPTION OF THE INVENTION

Figure 1:
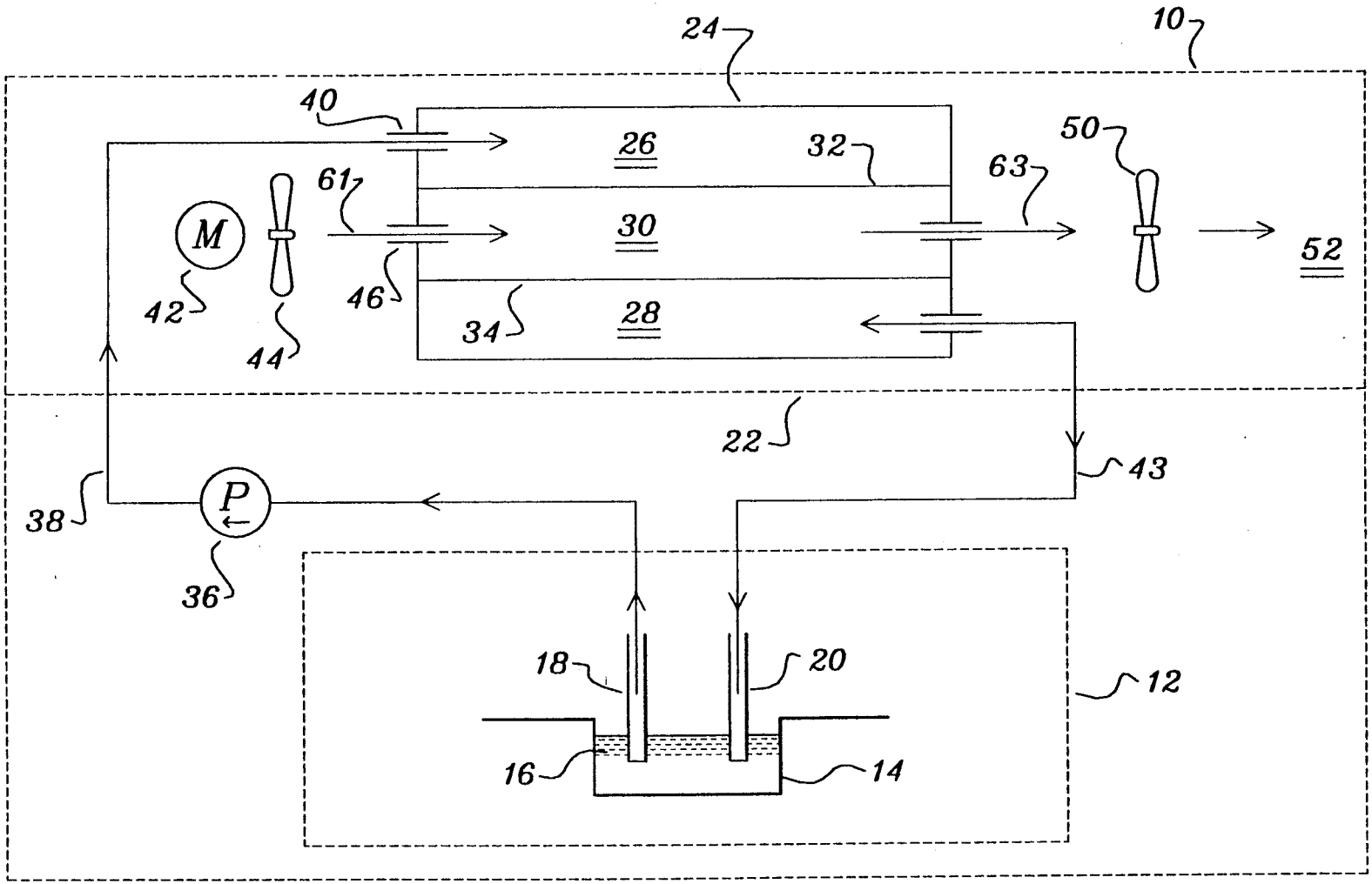
FIG. 1 is a schematic view showing the thermodynamic principles of operation of the present invention.

With regard to the schematic view of FIG. 1, the principles of operation of the inventive non-compressive supplemental air conditioning system may be seen. More particularly, it is noted that an outer dotted line represents a commercial establishment 10 while the inner dotted square, within establishment 10, represents an internal refrigerated inventory storage compartment 12, hereinafter referred to as refrigerated compartment 12. As above noted in the Summary of the Invention, it is to be understood that refrigerated compartment 12 represents a cooled compartment within a commercial establishment of the type having need to store otherwise perishable inventories such as food, medicinals, or chemicals. In colloquial terms, compartment 12 is often referred to as a walk-in cooler.

Shown within refrigerated compartment 12 is a reservoir 14 which contains a working fluid such as water 16. While the below set forth description of the invention makes reference to "water 16" it is to be understood that, within the scope of the invention, any working fluid having the properties of a liquid at atmospheric pressures and at temperature of to about 90 degrees Fahrenheit would be suitable for use in the instant system. Reservoir 14, in the schematic of FIG. 1 appears as open structure, however, in practice, reservoir 14 would take the form of a closed tank, such as a stainless steel water tank connected to a water supply. Reservoir 14 is provided with a fluid output 18 and fluid input 20.

At an elevation 22 within establishment 10 is positioned a heat exchanger 24 having working fluid input chamber 26 and a working fluid output chamber 28. Also provided is a central compartment 30 in which the walls thereof, namely, walls 32 and 34 are in thermal communication with compartments 26 and 28. Accordingly, from the view of FIG. 1 is may be seen that chilled water is pumped-up upward from reservoir outlet 18, by circulating pump 36, through conduit 38 and to input 40 of working fluid chamber 26 of heat exchanger 24. Concurrently with the above, warm air within the establishment 10 is pulled into central heat exchanger compartment 30 by the action of motor 42 and fan 44. In other words, air from employee and customer-occupied areas of the commercial establishment, that would otherwise be processed by a conventional compressor-driven air conditioning unit, is pulled into opening 46 of heat exchanger compartment 30 wherein, through said walls 32 and 34, the heat values of such inputted air are transferred to the water pumped into input chamber 26 and, after re-circulation through the heat exchanger, that is exited through output chamber 28 to conduit 48 for gravity-assisted return to reservoir input 20.

The symbol q in FIG. 1 represents heat values which travel in the direction shown by the vertical arrows within compartment 30. That is, there is schematically illustrated the manner in which heat q from air pulled into the heat exchanger through input 46 becomes transferred to water within the heat exchanger compartments 26 and 28, this in accordance with the laws of entropy which states that heat must always travel from a higher level to a lower level. In the heat exchanger shown in FIG. 1, compartment 30 is the region of higher thermal level, while chambers 26 and 28 are the regions of lower value. Accordingly, heat q will pass radially outwardly from compartment 30 and into the water circulated through chambers 26 and 28. Resultingly, the air pulled into heat exchanger compartment 32 will be reduced in temperature while the water circulated through the heat exchanger will be increased in temperature.

The thusly chilled air from compartment 30 will thereby be pulled by fan 50 outwardly from the heat exchanger 24 and into ductwork 52 of the commercial establishment 10, more fully described below.

It is to be appreciated that heat exchangers may take numerous physical forms but, regardless of form, all operate on the principle of transfer of unwanted thermal values from a first medium to a second medium in which the addition of thermal values to the second medium is a desirable or acceptable phenomena.

Figure 2:
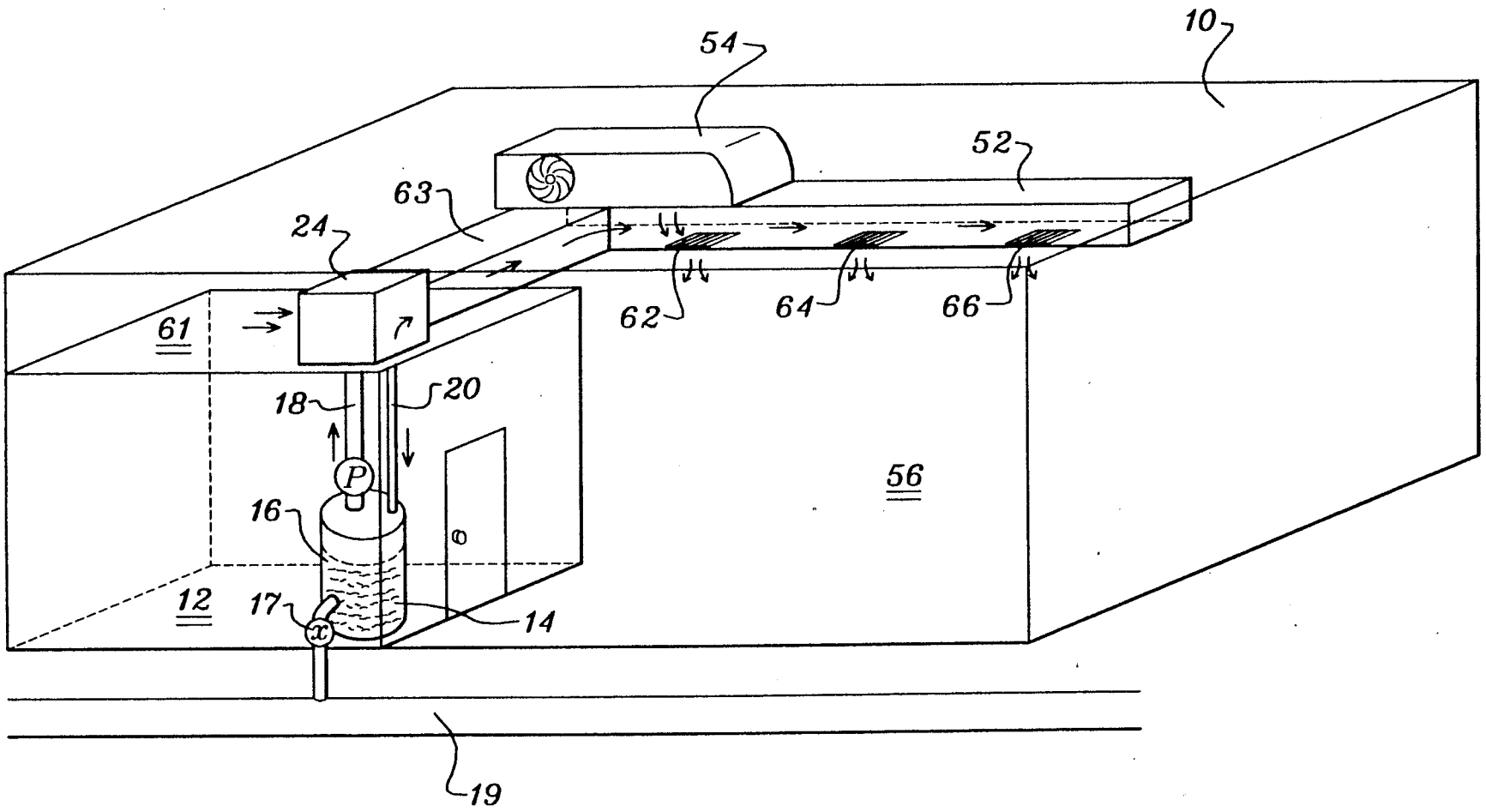
FIG. 2 is a perspective view showing the physical position of components of the system within a commercial establishment.
Figure 3:
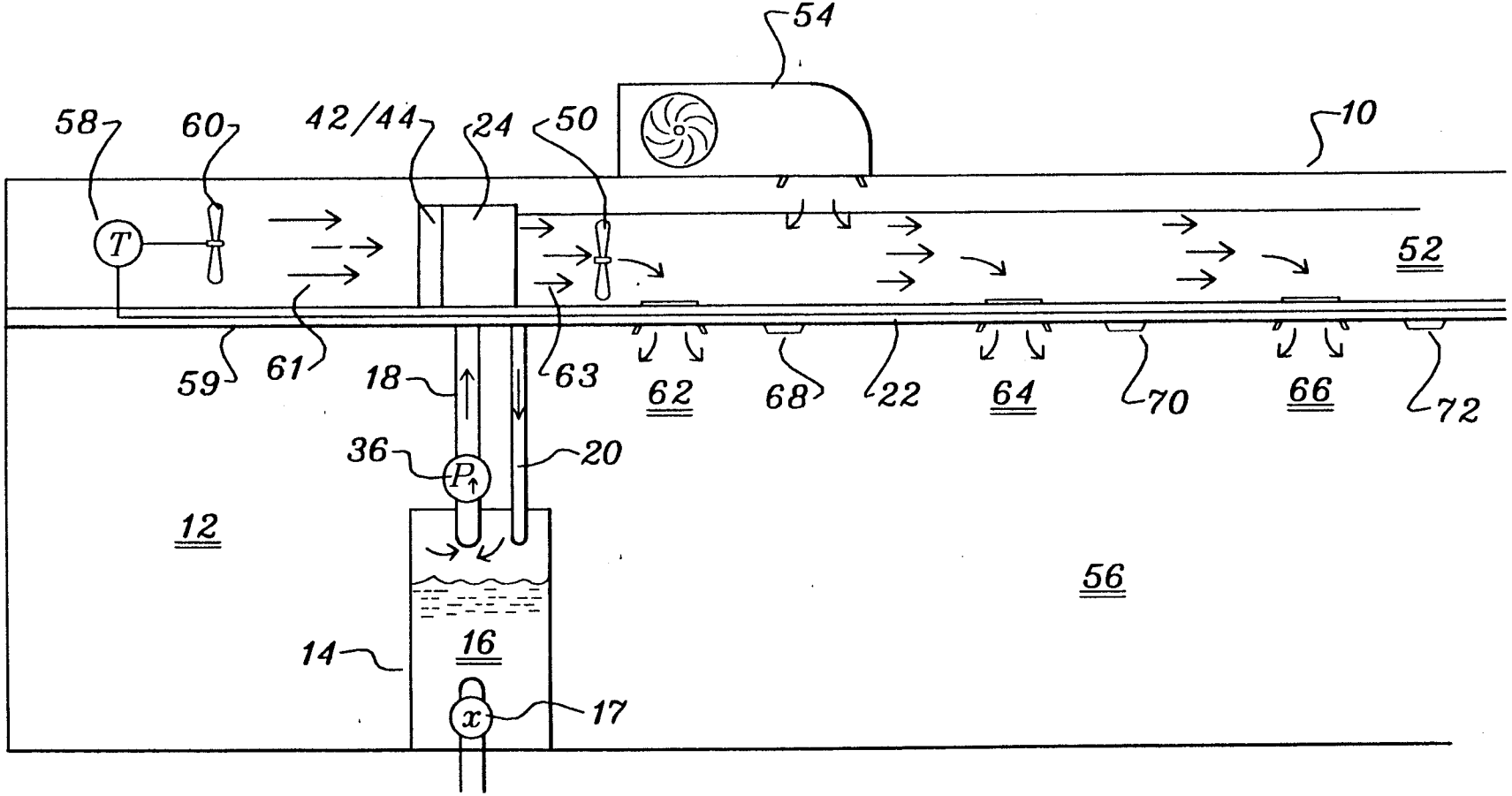
FIG. 3 is a side schematic view of the system shown in FIG. 2.
Figure 4:
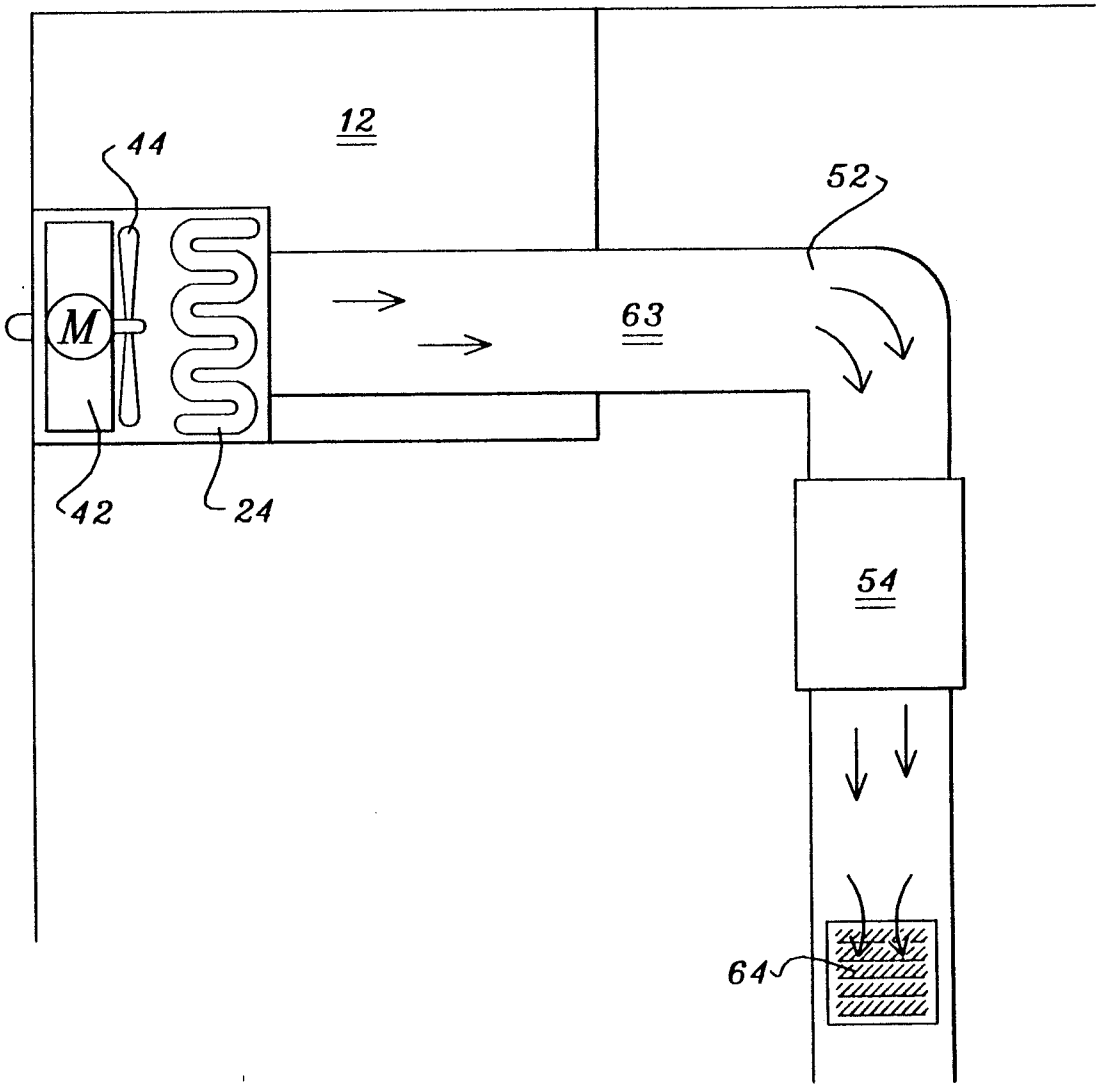
FIG. 4 is a top schematic view of the system of FIG. 2.

With reference to the view of FIGS. 2 to 4 the above described principles of operation of the invention are applied to the physical structure of a commercial establishment. For purposes of simplicity of understanding, all of the referenced numerals employed in FIG. 1 have been applied to similarly functioning components in FIGS. 2 to 4.

One element not shown or described in FIG. 1 is an air conditioning compressor 54 which serves the general refrigeration and air conditioning needs of the establishment 10, including refrigeration of compartment 12. It is to be understood that it is the air conditioning needs of establishment 10 in employee and customer-occupied areas 56 that the instant inventive system will afford savings of energy and cost.

Shown in the view of FIG. 3 is a thermostat 58 which operates a fan 60 to the left of the heat exchanger which draws air 67 into the heat exchanger. In the illustration of FIG. 4 it is noted that heat exchanger 24 will take the form of the well-known finned structure surrounded cooling coil. Therein the coiled component corresponds to above described compartments 26 and 28 of the heat exchanger while the finned region surrounding the coil corresponds to central region 30. The finned coil structure shown in FIG. 2 thereby represents one type of heat exchanger that may be used in the practice of the instant invention.

Air 63 then exists from heat exchanger 24 into ductwork 52 and, therefrom, through vents 62, 64 and 66 into employee and customer work area 56 of the establishment 10. If desired, thermostats 68, 70 and 72 connected by electrical wire 59 to thermostat 58 may be used in conjunction with said air returns 62 through 66, to more regulate cooling of the particular zones within area 56.

As above noted, the water or working fluid, after circulation through the heat exchanger will be returned to reservoir 14 and, over time, will be re-chilled to the temperature within compartment 12 which, generally, will be in the range of 34 to 39 degrees Fahrenheit. It is also noted that, if desired, circulating pump 36 may be used to continually re-circulate water through the working fluid circuit above described with reference to FIG. 1 such that the function of thermostat 58 is simply that of controlling motor and fan 42 and 44 respectively so that air 61 will be draw into input 46 of heat exchanger on a selective basis only when the temperature within area 56 exceeds a pre-set level, e.g., 75 degrees Fahrenheit. It is to be further understood that circulating pump 36 will, typically, include therein a pressure regulator for controlling the level of water pressure within the working fluid circuit of the system. It is, thereby, to be understood that there are only three components of the present system which could require maintenance, namely, pump 36, the pressure regulator therefore, and fan-motor combination 42/44. Accordingly, not only can a savings in energy be effected but, as well, a savings in the cost of maintenance of the conventional air conditioning unit 54 can be effected.

It is, in addition, to be appreciated that reservoir 14 may be chilled in any situation in which there exists an already refrigerated storage compartment within a commercial or industrial establishment.

Accordingly, while there has been shown and described the preferred embodiment of the present invention it is to be appreciated that the invention may be embodiment otherwise than in herein specifically shown and described without departing from the underlying ideas or principles of the invention within the scope of the claims appended herewith.

Having thus described my invention what I claim as new, useful and non-obvious and, accordingly, secure by Letters Patent of the United States is:

1. A system for cooling employee and customer-occupied areas of a commercial establishment having an internal refrigerated inventory storage compartment, the system comprising:

(a) a circulating fluid reservoir located internally within said refrigerated compartment, said reservoir being situated external of refrigeration elements of said refrigerated compartment and having no physical contact with such elements;

(b) means for continually supplying a portion of said circulating fluid from said reservoir to an input of an heat exchanger located external of said refrigerated compartment;

(c) means for returning said circulating fluid from an output of said heat exchanger to said reservoir;

(d) means for inputting air external of said refrigerated compartment through said heat exchanger to transfer thermal values of said external air to said circulating fluid; and (e) fan and duct means for distributing air outputted from said heat exchanger to said employee and customer areas of said commercial establishment, whereby air inputted to said heat exchanger will be cooled by the transfer its thermal values to said circulating fluid of said reservoir.

2. The system as recited in claim 1 in which said circulating fluid comprises water.

3. The system as recited in claim 1 in which said heat exchanger comprises a finned cooling coil in which said circulating fluid is inputted into said coil and, after circulation, outputted to said circulating fluid reservoir.

4. The system as recited in claim 3 in which said air inputting means comprises a fan.

* * * * *